US008298349B2

(12) United States Patent
Wojciechowski, III et al.

(10) Patent No.: US 8,298,349 B2
(45) Date of Patent: Oct. 30, 2012

(54) ROTATING FLUID NOZZLE FOR TUBE CLEANING SYSTEM

(75) Inventors: Donald Anthony Wojciechowski, III, Redford, MI (US); Matthew O. Herhold, Fenton, MI (US)

(73) Assignee: NLB Corp., Wixom, MI (US)

( * ) Notice: Subject to any disclaimer, the term of this patent is extended or adjusted under 35 U.S.C. 154(b) by 497 days.

(21) Appl. No.: 12/540,653

(22) Filed: Aug. 13, 2009

(65) Prior Publication Data

US 2011/0036376 A1 Feb. 17, 2011

(51) Int. Cl.
*B08B 9/093* (2006.01)

(52) U.S. Cl. ..... 134/167 C; 134/166 R; 134/167 R; 239/225.1; 239/251

(58) Field of Classification Search ..... 134/166 R, 134/167 R, 167 C; 239/225.1, 251
See application file for complete search history.

(56) References Cited

U.S. PATENT DOCUMENTS

| | | | |
|---|---|---|---|
| 1,977,763 | A | 10/1934 | Gordon |
| 3,433,489 | A | 3/1969 | Wiese |
| 3,802,515 | A | 4/1974 | Flamand et al. |
| 3,810,637 | A | 5/1974 | Bonvin |
| 4,114,703 | A | 9/1978 | Matson, Jr. et al. |
| 4,196,911 | A | 4/1980 | Matsushita |
| 4,225,000 | A | 9/1980 | Maurer |
| 4,246,976 | A | 1/1981 | McDonald, Jr. |
| 4,324,299 | A | 4/1982 | Nagel |
| 4,437,525 | A | 3/1984 | O'Hanlon et al. |
| 4,440,242 | A | 4/1984 | Schmidt et al. |
| 4,493,381 | A | 1/1985 | Kajikawa et al. |
| 4,521,167 | A | 6/1985 | Cavalleri et al. |
| 4,529,046 | A | 7/1985 | Schmidt et al. |
| D285,824 | S | 9/1986 | Anderson |
| 4,665,997 | A | 5/1987 | Maurer et al. |
| 4,715,538 | A | 12/1987 | Lingnau |
| 4,747,544 | A | 5/1988 | Kranzle |

(Continued)

FOREIGN PATENT DOCUMENTS

CN 2152606 Y 12/1994

(Continued)

OTHER PUBLICATIONS

Stoneage Waterblast Tools, Waterblast Solutions 2008 Catalog, pp. 24-25, Banshee Nozzles and Banshee Head Options.

(Continued)

*Primary Examiner* — Alexander Markoff
(74) *Attorney, Agent, or Firm* — Brooks Kushman P.C.

(57) ABSTRACT

A fluid nozzle for use in a high pressure water jetting system includes a housing to be fixed to a source of high pressure water. The housing receives a rotating member and an inner peripheral bore. The rotating member includes a shaft received within the housing, and a nozzle extending outwardly of the housing, the nozzle having openings extending along a direction having a component both forwardly along an axis of rotation of the shaft and the nozzle, and radially outwardly relative to the central axis. A central passage within the shaft communicates high pressure fluid to the nozzle. The shaft includes leakage paths to provide leakage fluid from the central passage to an interface between an outer peripheral wall of the shaft and an inner peripheral wall of the bore in the housing. The leakage paths communicate fluid to a forward fluid pressure chamber, and to a rearward fluid pressure chamber. A pressure loss to the rearward fluid pressure chamber is greater than a pressure drop at the forward pressure chamber.

9 Claims, 1 Drawing Sheet

U.S. PATENT DOCUMENTS

| | | | | |
|---|---|---|---|---|
| 4,821,961 | A | 4/1989 | Shook | |
| 4,905,775 | A | 3/1990 | Warren et al. | |
| 4,923,120 | A | 5/1990 | Hammelmann | |
| 4,934,254 | A | 6/1990 | Clark et al. | |
| 5,024,382 | A | 6/1991 | Shook et al. | |
| 5,028,004 | A | 7/1991 | Hammelmann | |
| 5,096,122 | A | 3/1992 | Abramoska | |
| D327,943 | S | 7/1992 | Tsai | |
| 5,135,015 | A | 8/1992 | Young | |
| 5,195,585 | A | 3/1993 | Clemens et al. | |
| 5,217,163 | A | 6/1993 | Henshaw | |
| 5,456,413 | A | 10/1995 | Ellis | |
| 5,531,383 | A | 7/1996 | Pacht | |
| 5,603,385 | A | 2/1997 | Colebrook | |
| 5,685,487 | A | 11/1997 | Ellis | |
| 5,857,623 | A * | 1/1999 | Miller et al. | 239/252 |
| 5,909,848 | A | 6/1999 | Zink | |
| 5,909,879 | A | 6/1999 | Simpson | |
| 5,938,206 | A | 8/1999 | Klosterman et al. | |
| 5,964,414 | A | 10/1999 | Hardy et al. | |
| 6,027,040 | A | 2/2000 | Frye-Hammelmann | |
| 6,059,202 | A | 5/2000 | Zink et al. | |
| 6,062,311 | A | 5/2000 | Johnson et al. | |
| 6,085,994 | A | 7/2000 | Zink | |
| 6,263,969 | B1 | 7/2001 | Stoesz et al. | |
| 6,347,675 | B1 | 2/2002 | Kollé | |
| 6,453,996 | B1 * | 9/2002 | Carmichael et al. | 166/177.3 |
| 6,557,856 | B1 | 5/2003 | Azibert et al. | |
| 6,698,669 | B2 | 3/2004 | Rieben | |
| 7,198,456 | B2 | 4/2007 | Kollé et al. | |
| 7,201,238 | B2 | 4/2007 | Marvin et al. | |
| 7,546,959 | B2 | 6/2009 | Wagner et al. | |
| 7,594,614 | B2 | 9/2009 | Vijay et al. | |
| 2005/0109541 | A1 | 5/2005 | Marvin et al. | |
| 2007/0257132 | A1 * | 11/2007 | Wright et al. | 239/259 |

FOREIGN PATENT DOCUMENTS

| | | | |
|---|---|---|---|
| CN | 2587520 | Y | 11/2003 |
| DE | 1568680 | A1 | 3/1970 |
| JP | 6171684 | A | 6/1994 |
| JP | 07155719 | A | 6/1995 |
| JP | 10211450 | A | 8/1998 |
| JP | 2000130294 | A | 5/2000 |
| SU | 587240 | A1 | 1/1978 |

OTHER PUBLICATIONS

Kollé, Jack J., A Comparison of Water Jet, Abrasive Jet and Rotary Diamond Drilling in Hard Rock, Presentation for Energy Sources Technology Conference & Exhibition (ETCE'98), Houston, TX, Feb. 2-4, 1998, pp. 1-7.

Kolé, Jack J., Moving an Ice Mountain, Tempress Technologies, Kent, Washington, Dec. 14, 2004, pp. 1-7.

* cited by examiner

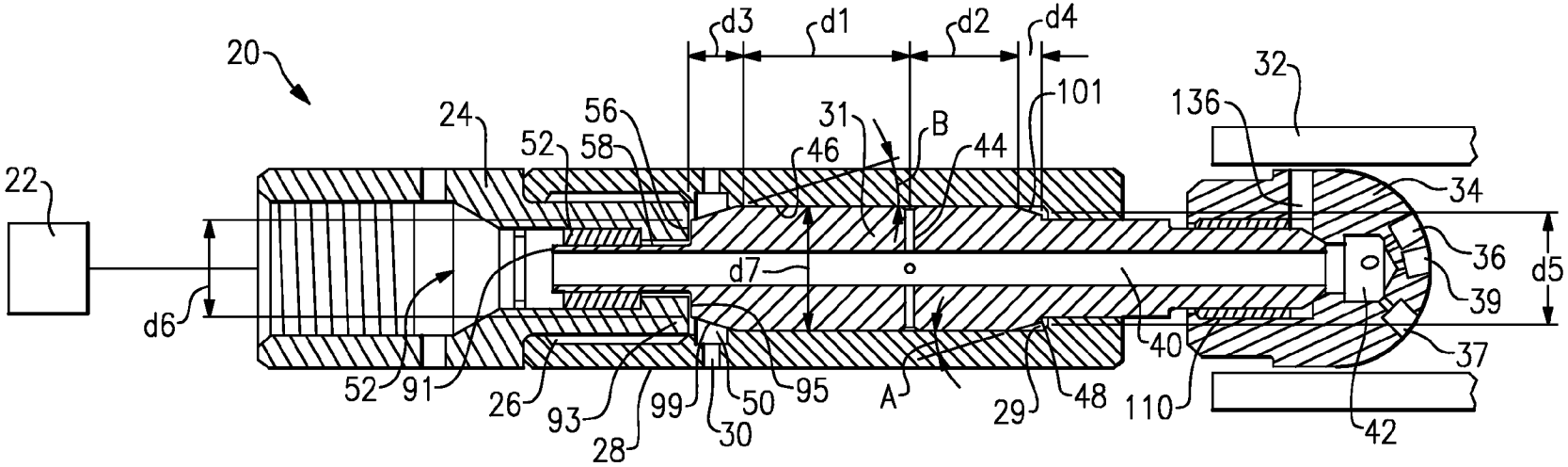
d5
34
36
39
37
42
32
136
40
110
d4
101
48
29
d2
44
B
A
d1
31
46
95
d7
50
30
d3
99
56
58
28
93
52
26
24
91
52
20
d6
22

ROTATING FLUID NOZZLE FOR TUBE CLEANING SYSTEM

BACKGROUND OF THE INVENTION

This application relates to a rotating nozzle for use in a cleaning system such as may be utilized to clean the interior of tubes, and wherein a pressure drop differential between an inlet side and an outlet side of a rotating shaft is utilized to provide a fluid thrust to properly support the shaft.

Systems utilized to clean the interior of tubes, or other small hollow parts, with the use of a high pressure water jets are known. Typically, a rotating fluid nozzle is inserted into the interior of a tube, and moved along that interior. A source of high pressure water is connected to the nozzle and jets outwardly of nozzle openings at a forward end of the nozzle. The jetting fluid impacts against an interior surface, cleaning the tube.

One challenge with such high pressure jet nozzles is the countering of the forces on the shaft from the water.

SUMMARY OF THE INVENTION

A fluid nozzle for use in a high pressure water jetting system includes a housing to be fixed to a source of high pressure water. The housing receives a rotating member and an inner peripheral bore. The rotating member includes a shaft received within the housing, and a nozzle extending outwardly of the housing. The nozzle has openings extending along a direction having a component both forwardly along an axis of rotation of the shaft and the nozzle, and radially outwardly relative to the central axis. A central passage within the shaft communicates high pressure fluid to the nozzle. The shaft includes leakage paths to provide leakage fluid from the central passage to an interface between an outer peripheral wall of the shaft and an inner peripheral wall of the bore in the housing. The leakage paths communicate fluid to a forward fluid pressure chamber, and to a rearward fluid pressure chamber. A pressure loss to the rearward fluid pressure chamber is greater than a pressure drop at the forward pressure chamber.

These and other features of the present invention can be best understood from the following specification and drawings, the following of which is a brief description.

BRIEF DESCRIPTION OF THE DRAWINGS

FIG. 1 is a cross-section through a rotating nozzle.

DETAILED DESCRIPTION OF THE PREFERRED EMBODIMENT

FIG. 1 shows a rotating nozzle head 20 for being connected to a source of high pressure fluid 22. One such source may be that disclosed in co-pending patent application Ser. No. 12/475,912, filed on Jun. 1, 2009, entitled "EASY CHANGE TUBE CLEANING SYSTEM."

However, other ways of providing pressurized water to the nozzle would come within the scope of this invention.

A first housing 24 includes threads to be secured to a component for delivering the water. A second fixed housing 28 is connected through a thread connection 26 to the first housing 24. The second housing 28 extends forwardly to a ledge 29. The ledge 29 extends radially inwardly relative to a central axis of the system 20 and provides a pressure fluid chamber 48 at an end of a rotating shaft 31.

The rotating shaft 31 has an inlet end 91, which has a relatively small outer diameter, and is received within a bushing. Bushing 52 minimizes leakage between the outer periphery of the portion 91 and the inner periphery of the first housing 24. A fluid pressure chamber 58 is defined forwardly of the bushing 52, and a thrust bearing surface 56 is defined between a ledge 93 on the first housing 24 and a rear face 95 of the rotating shaft 31.

This thrust area 95 communicates with an enlarged chamber 50 defined by a conical portion 99 of the shaft and an inner periphery of the second housing member 28. The enlarged chamber 50 communicates with openings 30, which direct fluid to atmosphere.

A central passage 40 communicates pressurized fluid to a nozzle chamber 42 in a nozzle 34. As can be seen, communication passages 44 extend from central passage 40 radially outwardly to an outer peripheral surface of the shaft 31. Fluid delivered through the passages 44 passes along relatively small leakage paths both toward the inlet end and the outlet end of the rotating shaft. The paths are formed between the inner periphery 46 of the housing 28 and the outer periphery of the shaft 31. Leakage forwardly, or toward the right in this FIGURE, reaches the chamber 48. The chamber 48 is defined in part by a conical forward surface 101 of the shaft 31. Leakage rearwardly, or the left in this FIGURE, reaches the chamber 50. From chamber 50, this fluid will leak outwardly of the opening 30 to atmosphere. On the other hand, fluid will leak through the bushing 52, into chamber 58, and to the thrust surfaces 95/56. The pressure drop for the fluid moving to the left, compared to the pressure drop to the fluid moving to the right, is much higher. Thus, the pressure of the fluid on the thrust area 95 is lower than the pressure in the chamber 48. Due to this, there is an overall force forcing the shaft 31 to the left, and will counteract reaction forces from the fluid jets, and forces at the inlet end. On the other hand, the provision of the pressurized fluid to the surface 56 does ensure that the rotating shaft 31 will be lifted off of the surface 93 of the first housing member 24.

Fluid reaching the chamber 42 then communicates through nozzle holes or ports 36, 37 and 39. As can be appreciated, each of these holes have a component extending forwardly, or further into a tube 32. On the other hand, these nozzles are not directly along that axis, but each have a component extending radially outwardly. The shaft is driven to rotate by the offset ports Fluid that leaks between the nozzle 34 and the outer periphery of the shaft 31 will reach a hole 136.

As can be appreciated from FIG. 1, the axial location of the communication holes 44 is closer to the chamber 48 than it is to the thrust surface 56. This plays a part in the lower pressure drop for the fluid reaching the chamber 48.

As can be appreciated from the FIGURE, a distance d1 from the central passages 44 to the beginning of the rearward conical portion 99 is greater than a distance d2 from the central passages to the beginning of the forward conical portion 101. The forward conical portion extends over a distance d4 while the rearward conical portion extends over a distance d3, which is greater than d4. The outer diameter at the end of the forward conical portion is d5, and is greater than an outer diameter at the end of the rearward conical portion d6. The angle of the rearward conical portion B is greater than the angle A of the forward conical portion. In one embodiment, d1 was 0.438", d2 was 0.255", d5 was 0.127", d4 was 0.080", d5 was 0.280", d6 was 0.250", and a nominal outer diameter d7 was 0.3183". The angle A was approximately 13.5°, and the angle B was approximately 15°.

An inlet area can be defined as the end of the inlet end 91, including the bore 40. The bore 40 will also act as a reaction surface, since at its end, the fluid will react against the nozzle 34. A shoulder area can be defined as the surface area of the forward conical portion 101, or the area formed between shaft outer diameter d7 and the shoulder diameter d5. In the above-mentioned embodiment, the inlet area would be 0.0113/0.0112 $in^2$, while the shoulder area is 0.0203/0.0180 $in^2$. The ratio of the shoulder area to the inlet area is preferably between 1.8 and 1.6. The inlet area is inversely proportional to the forward leak length d2. 1/leak length=350*inlet area in one embodiment. The value of 350 is of course exemplary, and the ratio of 1/leak length can range between 345 and 355 of the inlet area.

The clearance between the housing body and the shaft is important in defining the pressure drop toward the output end of the shaft. A larger clearance area results in less pressure drop toward the outlet end, and would require a smaller shoulder area. The outer diameter d7 is thus preferably between 0.317" and 0.320". The ratios for the forward link length d2, the inlet area, and the shoulder area are dependent on having a clearance of between 0.001" and 0.003".

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A fluid nozzle for use in a high pressure water jetting system comprising:

a housing configured to receive a source of high pressure water, said housing having defined therein an inner peripheral bore;

a rotating member disposed within said inner peripheral bore, said rotating member including a shaft received at its rearward end within a bushing disposed in said housing, and a nozzle extending outwardly of said housing, said nozzle having openings extending along a direction that is oblique to an axis of rotation of said shaft and said nozzle;

a central passage within said shaft for communicating high pressure fluid to the nozzle, and said shaft including leakage paths to provide leakage fluid from said central passage to an interface between an outer peripheral wall of said shaft and an inner peripheral wall of said bore in said housing, with said leakage paths communicating fluid to a forward fluid pressure chamber defined between the shaft and the housing, and to a first rearward fluid pressure chamber defined between the shaft and the housing; and a second rearward fluid pressure chamber defined between the shaft and the housing and adjacent to the bushing, the second rearward fluid pressure chamber configured to receive water that has leaked through the bushing and transport it to opposing thrust surfaces on the housing and the shaft, thereby applying a forward force to partially balance a rearward force generated by the forward fluid pressure chamber.

2. The nozzle as set forth in claim 1, wherein said central passage communicates with communication holes to communicate high pressure water to the interface between the inner peripheral wall of said bore and the outer peripheral wall of said shaft, and said communication holes being axially intermediate said forward and first rearward pressure chambers.

3. The nozzle as set forth in claim 2, wherein said communication holes being closer to said forward pressure chamber than they are to said first rearward pressure chamber.

4. The nozzle as set forth in claim 3, wherein at least a portion of said forward pressure chamber is defined by a forward conical portion extending radially inward in said shaft towards the nozzle and at least a portion of said first rearward pressure chamber is defined by a rearward conical portion extending radially inward in said shaft away from the nozzle.

5. The nozzle as set forth in claim 4, wherein an angle between the outer peripheral wall of the shaft adjacent the rearward conical portion and a surface of the rearward conical portion is greater than an angle between the outer peripheral wall of the shaft adjacent the forward conical portion and a surface of the forward conical portion.

6. The nozzle as set forth in claim 1, wherein said first and second rearward pressure chambers communicate with a passage to atmosphere.

7. The nozzle as set forth in claim 4, wherein the rearward end of the shaft comprises an inlet having a cross sectional inlet area, and a ratio of a cross sectional area of the forward conical portion of the shaft to the cross sectional inlet area is between 1.8 and 1.6.

8. The nozzle as set forth in claim 7, wherein a leak length is defined as a length of the leakage path to the forward pressure chamber, and a value of 1/leak length equals between 345 and 355 multiplied by the cross sectional inlet area.

9. The nozzle as set forth in claim 1, wherein a clearance between the shaft and the housing is between 0.001" and 0.003".

* * * * *